United States Patent [19]

Moeckl

[11] Patent Number: 4,907,207

[45] Date of Patent: Mar. 6, 1990

[54] ULTRASOUND TRANSDUCER HAVING ASTIGMATIC TRANSMISSION/RECEPTION CHARACTERISTIC

[75] Inventor: Thomas Moeckl, Munich, Fed. Rep. of Germany

[73] Assignee: Siemens Aktiengesellschaft, Berlin and Munich, Fed. Rep. of Germany

[21] Appl. No.: 249,281

[22] Filed: Sep. 26, 1988

[30] Foreign Application Priority Data

Sep. 25, 1987 [DE] Fed. Rep. of Germany ..... 3732412

[51] Int. Cl.[4] ..... G10K 13/00

[52] U.S. Cl. ..... 367/140; 367/174; 367/163; 181/170; 310/324; 381/202; 381/190

[58] Field of Search ..... 181/170; 310/324; 367/150, 157, 160, 163, 165, 174, 909, 140; 381/162, 190, 202, 153

[56] References Cited

U.S. PATENT DOCUMENTS

| | | | |
|---|---|---|---|
| 4,031,502 | 6/1977 | Lefaudeux et al. | 367/151 |
| 4,045,695 | 8/1977 | Itagaki et al. | 310/322 |
| 4,440,983 | 4/1984 | Facoetti et al. | 181/170 |
| 4,460,060 | 7/1984 | Hasumi et al. | 181/169 |

FOREIGN PATENT DOCUMENTS 0075302 3/1983 European Pat. Off. .

*Primary Examiner*—Deborah L. Kyle
*Assistant Examiner*—J. Woodrow Eldred
*Attorney, Agent, or Firm*—Hill, Van Santen, Steadman & Simpson

[57] ABSTRACT

A transducer which has an astigmatic directional characteristic which depends on its assymetrical stiffness or, respectively, speed of sound of the material of a resonant membrane (2) which is composed of a composite fiber material.

9 Claims, 1 Drawing Sheet

ULTRASOUND TRANSDUCER HAVING ASTIGMATIC TRANSMISSION/RECEPTION CHARACTERISTIC

CROSS-REFERENCES TO RELATED APPLICATIONS

This application is related to application entitled "Ultrasound Transducer Having Astigmatic Transmission Reception" in which the inventor is Valentin Magori assigned to the assignee of the present application identified by Ser. No. 249,288, filed 9-26-88.

BACKGROUND OF THE INVENTION

1. Field of the Invention

The present invention relates to an ultrasound flexural transducer.

2. Description of the Related Art

European Pat. No. EP-B-0 075 302 discloses a sensor for making a distance measurement based on the ultrasound echo principle. This sensor is intended to serve for the calculation and display of distances between a vehicle and obstructions in the near region. This device uses an insulator-type transducer which has a piezoceramic oscillator mounted therein. Damping material which prevents a high-energy ultrasound emission or signal emission is provided on the inside of the membrane of this insulator-type transducer at two horizontal circular segment positions which are opposite to each other. The damping material may, for example, be soft rubber. The insulator-type transducer is formed as a horn radiator in the above-recited reference.

The membrane of the insulator-type transducer forms the floor of the container. Due to the damping material which is asymmetrically distributed relative to a normal axis to the membrane or, respectively, to the floor of the container, the transducer has a correspondingly asymmetrical transmission and reception characteristic and an asymmetrical transmission and reception lobe. A connecting line between the portions of damping material which are asymmetrically located in the inside of the insulator-type transducer can be visualized for the insulator-type transducer. Such connecting line extends perpendicularly to the surface which is normal to the membrane which is the floor of the container. The connecting line and the surface which is normal form a plane. The sound propagation or the sound reception characteristic in such plane is essentially a single radiation lobe which has the normal as a center line.

In a plane perpendicular to this plane, the radiation characteristic has a plurality of radiation lobes in which the middle radiation lobe has the surface normal to the membrane as a middle line, similar to the radiation lobe listed above.

Such an insulator-type transducer thus fundamentally has a broad radiation field for emission and/or reception in the one plane which is the vertical plane. In the plane perpendicular thereto, this transducer has a relatively narrow characteristic, so that an astigmatic sound characteristic results.

SUMMARY OF THE INVENTION

It is an object of the invention to provide a transducer structure which has an optimally improved and, in particular, a selectable astigmatic radiation characteristic which can be manufactured simply and reproducibly and which is free of aging effects.

This object is achieved with an ultrasound flexural transducer having the features of the invention.

The known employment of damping material for achieving astigmatic characteristic has the disadvantage in that considerable variations of the characteristic values of such transducers result during mass production and no adequate resistance to aging can be achieved. The invention is therefore based on the idea of using an actual insulator-type transducer which has characteristic properties which can be prescribed and are always reproducible and/or reliably maintained.

A transducer of the invention comprises a membrane which is preferably a part forming a floor of a cylindrically-shaped transducer formed with a planar end and extending cylindrical sidewall. The membrane is composed of a plate which forms the end or floor of non-piezo-electric material and of a lamina of piezoelectric material secured thereto. Such piezo-electrical material is preferably piezo-ceramic, for example, a piezoceramic containing lead zirconate titanate.

A transducer of the invention has anistropic, elastic properties with respect to two planes which are perpendicular to each other in which the normal of the plane of the membrane lies. There is a corresponding transition behaviour in the membrane for the space between the two principal planes. The elasticity and the stiffness can also be specified.

The anistropic elastic properties are inventively achieved in that the piezo-electrically inactive plate of the membrane is at least partly composed of a composite fiber material. A composite fiber material comprising fibers having a privileged direction is provided. According to a modification, the composite fiber material has fibers which are aligned in only one direction and extend essentially parallel to each other. As a result, the plate has a considerably different elasticity response in a direction which is parallel to the fibers, and in a direction which is transverse to the fibers. Instead of providing only a single direction for the fibers, the fibers are aligned in two directions which are oriented at an acute angle relative to each other. This embodiment gives a plate of composite fiber material greater strength without the anistropic elasticity behavior of the plate being modified to a substantial extent.

With only one principal fiber direction, it can be extremely advantageous to provide one or more additional fiber layers to obtain greater strength, and these one or more additional fiber layers extend essentially transversely relative to the one principal fiber direction. The fiber layers, however, are selected such that the desired anistropy is not significantly unfavorably influenced, i.e. the number of fibers in the second direction is significantly lower and/or the fibers in that direction are significantly weaker, so that a significantly greater stiffness in the direction parallel to the principal fiber direction remains.

Another embodiment provides that the plate is composed of a tangled fiber material, that, however, has a privileged orientation of the fibers resulting in that the direction of the principal fiber direction has a greater stiffness. Such a privileged orientation can be realized during the manufacture of such material.

Carbon fibers, magnesium fibers, aluminum fibers, Keflar fibers, and the like preferably can be used as the fiber material. Polyimide is to be preferably employed as the matrix material in which the fibers are embedded.

Other objects, features and advantages of the invention will be readily apparent from the following description of certain preferred embodiments thereof taken in conjunction with the accompanying drawings although variations and modifications may be effected without departing from the spirit and scope of the novel concepts of the disclosure and in which:

BRIEF DESCRIPTION OF THE DRAWINGS

FIG. 8 illustrates an elliptical embodiment.

DESCRIPTION OF THE PREFERRED EMBODIMENTS

Figure 1:
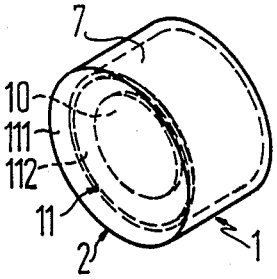
FIG. 1 is a perspective view of a fundamental form of an insulator-type transducer which is the preferred embodiment of the invention.

The transducer 1 shown in FIG. 1 is pot-shaped and comprises a hollow cylindrical member 7 with membrane 2 which forms a planar end or floor. The membrane 2 is formed of a plate of piezoelectrically inactive material which forms the actual floor of the device in this embodiment. The plate can be completely composed of composite fiber material. A lamina 10 of piezomaterial, particularly piezo-ceramic, is secured to the surface of the face of the membrane 2 which is located in the interior of the pot-shaped member 7.

Figure 2:
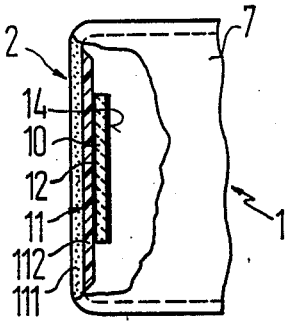
FIG. 2 is a cross-sectional view of a transducer of the invention in pot form which has composite fiber material with fibers aligned in parallel.

FIG. 2 shows a section through the lamina 10 of piezo-ceramic which might be, for example, lead zirconate titanate. One electrode 14 of the piezo-electric lamina 10 is shown. An adhesive layer 12 attaches the lamina 10 to the piezoelectrically inactive plate 11. Plate 11 and the lamina 10 form the membrane 2. A significant part 111 of the plate 11 is composed of composite fiber material and a further additional plate 112 can be a component part of plate 11.

For example, the composite fiber material may be composed of polyimide as a matrix material in which fibers of, for example, carbon, magnesium, aluminum, Keflar and the like are present. The portion 112, for example, can be a plate or, respectively, a layer of pure polyimide.

An electrode which cooperates with the electrode 14 is provided for the lamina 10. The cooperating electrode, for example, can be realized by the electrical conductivity of the adhesive layer 12.

In FIG. 2, the fibers are indicated in a sectional view. The orientation of the fibers can be seen in greater detail in FIG. 3, which shows a portion in the middle of the FIG. The fibers 21 illustrated in FIG. 3 essentially extend horizontally and parallel to each other. They give the composite fiber material 111 of the membrane 2 high stiffness and respectively, high speed of sound transmissivity in the horizontal principal direction 4. In the direction 5 orthogonal to direction 4, the composite fiber material has a correspondingly low stiffness and, respectively, a low speed of sound transmissivity.

Figure 3:
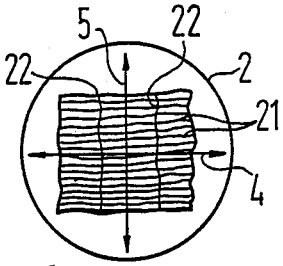
FIG. 3 is a plan view showing a portion of an embodiment of the invention which also contains a few auxiliary fibers which extend in perpendicular direction.
Figure 4:
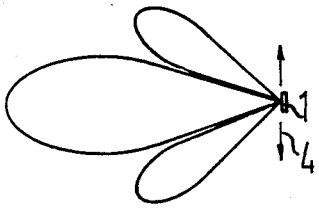
FIG. 4 is a directional diagram showing the two principal planes of astigmatism.
Figure 5:
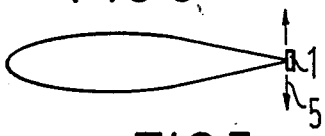
FIG. 5 is a directional diagram showing the planes of astigmatism.

FIGS. 4 and 5 show the sound transmission/reception diagrams for the directions 4 and 5 which are orthogonal relative to each other as shown in FIG. 3. The broad radiation lobe of FIG. 4 in whose plane the principal direction 4 lies is a result of the inventively selected arrangement for the fibers and essentially in the illustrated direction 4 of the fibers 21. The individual fibers 22 extend orthogonally relative to the principal direction 4 of the fibers 21. The fibers 22 serve the purpose of giving the composite fiber material at least the stiffness in the direction 5 which must as a minimum be present. As compared to the large numbers of fibers 21, however, the fibers 22 do not cause any substantial deterioration of the asymmetry, which is the astigmatism of the transducer.

Figure 6:
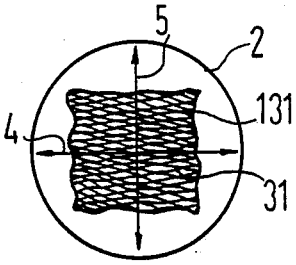
FIG. 6 illustrates an embodiment which has a directional arrangement of the fibers in two directions which have an acute angle relative to each other.

FIG. 6 shows an embodiment which has an arrangement of fibers 31 and 131. In the illustration of FIG. 6, the fibers 31 extend at a small angle (less than about 30 degrees relative to the horizontal) from the upper right to the lower left. The fibers 131, by contrast, extend from the lower right to the upper left with essentially the same small angle. Such acute-angled crossing of the fibers results in producing stability in the plate 11 of composite fiber material without requiring transversely extending fibers 22. Nonetheless, the arrangement of the fibers 31 and 131 produces a property for effecting a decisive privileged direction 4 for the transmission or, respectively, reception characteristic of the transducer.

Figure 7:
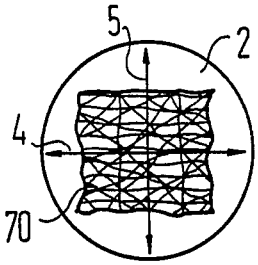
FIG. 7 illustrates an embodiment of tangled fleece which has privileged orientation.

FIG. 7 is an enlarged view similar to FIGS. 3 and 6; which shows tangled fleece fibers which have a privileged alignment (again in horizontal direction of the illustration in FIG. 7).

For characteristic oscillatory modes, both for the fundamental wave as well as for harmonics result for a transducer which has different degrees of stiffness or, respectively, different speed of sound characteristics in the material of the membrane in two mutually orthogonal directions of the plane of the membrane. The oscillatory modes are necessarily coupled to each other by the material of the membrane.

Only one fundamental resonance occurs in the transducer of the invention. Relative to harmonics, an essentially paired occurrence of resonances has been observed, relative to the two orthogonal directions, 4 and 5. In the invention, the frequencies of the paired resonances advantageously lie so far apart that there is no chance that, during operation, the transducer will jump from the oscillatory mode of the intentionally excited harmonic to the oscillatory mode of the other harmonic.

An advantageous dimensioning of a transducer of the invention is selected such that for a given fiber material (for example carbon fiber) which has anistropy according to the invention such that the resonant frequencies of the transducer are matched to one another such that suitable or prescribed, astigmatic directional characteristics (FIGS. 4 and 5) result for one of the frequencies. The transducer is advantageously operated at this frequency of the harmonic.

With a transducer according to, for example, FIGS. 2 and 3 which has a circular carbon fiber membrane that, for example, is 0.4 mm thick and about 20 mm in diameter and which has fibers 21 (FIG. 3) aligned in parallel, there is a clear difference of the resonant frequencies of the first harmonic and of the second harmonic in the direction 4 which has a high speed for sound of the membrane as compared to the resonant frequency of the first and of the second harmonics for the direction 5 which has a low speed for sound. The membrane has four layers comprising fibers 21 in the principal direction 4 and one layer of fibers 22 in direction 5. The suitable operating frequency is at 40 kHz, which is the frequency of the first harmonic of the oscillatory mode for the high speed of sound. The neighboring resonances which relate to the harmonics of the oscillatory mode for the lower speed of sound (direction 5) are at 27 and 53 kHz, i.e. at a sufficiently large spacing from the 40 kHz operating frequency. A transducer of the invention has a stable oscillatory characteristic and has a directional characteristic as shown in FIGS. 4 and 5 for 125° for the plane shown in FIG. 4 and for 50° for the plane shown in FIG. 5.

It may be pointed out that further adaptations can be achieved with a membrane shape which differs from the disclosed circular membrane shape. For example, an elliptical shaped membrane can be provided as shown in FIG. 5. The axes of the ellipse are selected to be parallel to the directions 4 and 5.

Carbon fiber composite material is especially beneficial for transducers of the invention. An especially beneficial impedance matching to air results with such material.

The employment of an aligned tangled fleece gives a further advantage. Such fleece of tangled fibers has relatively high self-damping, so that the additional employment of damping material, so as to obtain adequate bandwidth is not needed. It may be pointed out that the use of additional damping material in the invention is not the same as the material which is provided in the prior art previously described to correct for astigmatism of the directional characteristic. Additional damping material used in the invention does not effect the directional characteristic and, in particular, does not deteriorate the inventively achieved, astigmatic characteristic due to aging effects.

A transducer of the invention is particularly suitable as a detection transducer for land and water vehicals wherein broad "illumination" is desirable parallel to the plane of the travel path (FIG. 4) where in contrast very little sound should be emitted in the elevation direction. The transducer of the invention fulfills such requirements. A transducer of the invention can be used both as a transmitter as well as a receiver.

A preferred use of a transducer of the invention is as an aid for backing heavy vehicles which have impaired view toward the back of the vehicles (excavators and the like) and which frequently move back and forth.

Although the invention has been described with respect to preferred embodiments, it is not to be so limited as changes and modifications can be made which are within the full intended scope of the invention as defined by the appended claims.

I claim as my invention:

1. An electro-acoustical flexural transducer which is cylindrical-shaped formed with a planar ends and extending cylindrical sidewall, comprising a membrane with at least one surface which is a composite of a plate having at least one surface and of piezo-electrically inactive material and a lamina of piezo-electric material, and said lamina centrally arranged on the surface of the plate and connected to said plate, electrodes for said piezo-electric lamina, said transducer has an asymmetrical three-dimensional sound directional pattern relative to the normal to said surface of the membrane, characterized in that the plate (11) comprises a composite fiber material which has its fibers substantially oriented in the same direction (4) and parallel to said surface and said composite fiber material forming at least one layer (111) of said plate.

2. An electro-acoustical transducer according to claim 1, wherein said plate (11) is composed entirely of composite fiber material (21; 31, 131, 70).

3. An electrode-acoustical flexural transducer which is cylindrically-shaped formed with a planar ends and extending cylindrically sidewall, comprising a membrane with at least one surface which is a composite of a plate having at least one surface and of piezo-electrically inactive material and a lamina of piezo-electric material, and said lamina centrally arranged on the surface of the plate and connected to said plate, electrodes for said piezo-electric lamina, said transducer has an asymmetrical three-dimensional sound directional pattern relative to the normal to said surface of the membrane, characterized in that the plate (11) comprises a composite fiber material; and wherein said composite fiber material 60° relative to each other and extend generally in the same direction.

4. An electro-acoustical transducer according to claim 1 wherein an additional layer of fibers (22) are provided which extend essentially transversely relative to said same direction (4).

5. An electro-acoustical flexural transducer which is cylindrically-shaped formed with a planar ends and extending cylindrical sidewall, comprising a membrane with at least one surface which is a composite of a plate having at least one surface and of piezo-electrically inactive material and a lamina of piezo-electric material, and said lamina centrally arranged on the surface of the plate and connected to said plate, electrodes for said piezo-electric lamina, said transducer has an asymmetrical three-dimensional sound directional pattern relative to the normal to said surface of the membrane, characterized in that the plate (11) comprises a composite fiber material; and wherein said composite fiber material is a tangled fiber material (70) which has a majority of said fibers which extend in the same direction (4).

6. An electro-acoustical flexural transducer according to claim 1 wherein one or more types of fiber are selected from the group consisting carbon fibers, magnesium fibers, aluminum fibers.

7. An electro-acoustical flexural transducer according to claim 1, in that said composite fiber material is made from polyimide.

8. An electro-acoustical flexural transducer according to claim 1, wherein said plate (11) forms said planar end and said composite fiber material of said plate extends across said transducer.

9. An electro-acoustical flexural transducer according to claim 1, said membrane (2) has an elliptical shape.

* * * * *